US005457914A

United States Patent [19]

Johnson, Jr.

[11] Patent Number: 5,457,914

[45] Date of Patent: Oct. 17, 1995

[54] SAFETY GATE FOR JUVENILES WITH SECURITY BRACKETS

[76] Inventor: Marvin B. Johnson, Jr., 25 Magnolia Dr., Newnan, Ga. 30263

[21] Appl. No.: 345,443

[22] Filed: Nov. 21, 1994

[51] Int. Cl.[6] ..... E06B 3/32

[52] U.S. Cl. ..... 49/463; 49/55; 49/57

[58] Field of Search ..... 49/463, 50, 55, 49/57; 160/222, 225, 135, 136

[56] References Cited

U.S. PATENT DOCUMENTS 2,490,612 12/1949 Ballard ..... 160/225

2,581,857 1/1952 Garrison ..... 49/55 X

*Primary Examiner*—Philip C. Kannan

*Attorney, Agent, or Firm*—John G. Semmes

[57] ABSTRACT

The invention is characterized by at least one bracket 20 which is rotatably attached to a child's safety gate 10. The bracket defines a pedestal anchor 30 which is fixed to the gate, a rotatable clamp 60 being rivet-spring connected thereto, whereby the clip having pads 68 thereon may be pressed against door jamb or passageway walls to secure the gate against displacement, irrespective of shaking forces which may be applied to the gate. The bracket 60 is compressibly mounted relative to the anchor 30 such that the pads thereof clamp the gate against a fixed surface such as wall or doorjamb, supplementing the gate buffers 12, whereby displacement of the gate is rendered impossible.

4 Claims, 2 Drawing Sheets

SAFETY GATE FOR JUVENILES WITH SECURITY BRACKETS

BACKGROUND OF THE INVENTION

Safety gates for children of toddler age are characteristically extensible and retractable between doorjambs and/or opposed walls and/or balustrade uprights, and the like. Characteristically, the safety gates are provided on ends thereof with buffer stops, generally made of an elastomeric substance which when compressed serves to effectively set the safety gate against displacement between opposed fixed extremes such as one finds in a doorjamb. Usually in the prior art, ends of extensible-retractable portions of the gate bear opposed flanges which extend outwardly in a U-shaped configuration to engage opposite jambs of a door or related passageway closure. Often these flanges are padded to overcome rattling and to more effectively secure ends of the safety gate, adjacent opposed jambs of a given door within a passageway. Heretofore, no provision has been made therein for spanning of the doorstop which is disposed vertically along the inside of the doorjamb, whereupon extant gate constructions are unstable, rendering the safety gate deficient in stabilizing it against undesirable displacement by the toddler or other persons.

The present invention overcomes the aforementioned deficiency and by reason of an unique construction, permits a rotatable V-foot clamp to engage the interior portions of the doorjamb, including the upright door stop in either vertical or horizontal disposition, to effectively enhance the compressive action of the resilient doorjamb buffers which generally extend laterally from ends of the extensible-retractable gate. In the present invention, a complementary anchor is disposed in-line with said resilient buffers, especially to enhance the effect thereof which by compression partial clamp fixes the safety gate relative to the doorjamb. Also a supplementary V-foot herein spans the doorjamb stop in its horizontal disposition and/or rests contiguous said stop in an alternate vertical disposition relative to the safety gate, per se. The V-foot clip serves as a spanner, providing with its padded extensions multiple points of friction-engaging contact with the doorjamb or opposed wall surfaces.

Information Disclosure 35 U.S.C. §1.97

The description of the prior art is best represented by the following United States Letters Patent:

| INVENTOR | DATE | U.S. PAT. NO. | DESCRIPTION |
|---|---|---|---|
| Rexinger, O. M. | March 1928 | 1,662,167 | Window Grating |
| Ballard, L. W. | Dec., 1949 | 2,490,612 | Barrier for Doorways |
| Brueggeman, J. T. | Dec., 1970 | 3,545,049 | Releasible Connector |
| Ruggles et al | March 1990 | 4,908,915 | Clip for Ceiling Grid |
| Heinz | May 1990 | 4,923,176 | Fence Angular Connector |

From an examination of the aforementioned prior art it will be appreciated that the distinctions in invention hereunder are evident from a close examination of the ensuing description, drawings and claims. More specifically, the simplicity of bracket construction, assembly and installation upon safety gates of varying size, highlight the invention in its distinctive characteristics. Notably, the present invention will substantially increase the security of any pressure-mounted safety gate, as will be apparent from the ensuing description, drawings and claims.

DESCRIPTION OF PREFERRED EMBODIMENTS

Figure 1:
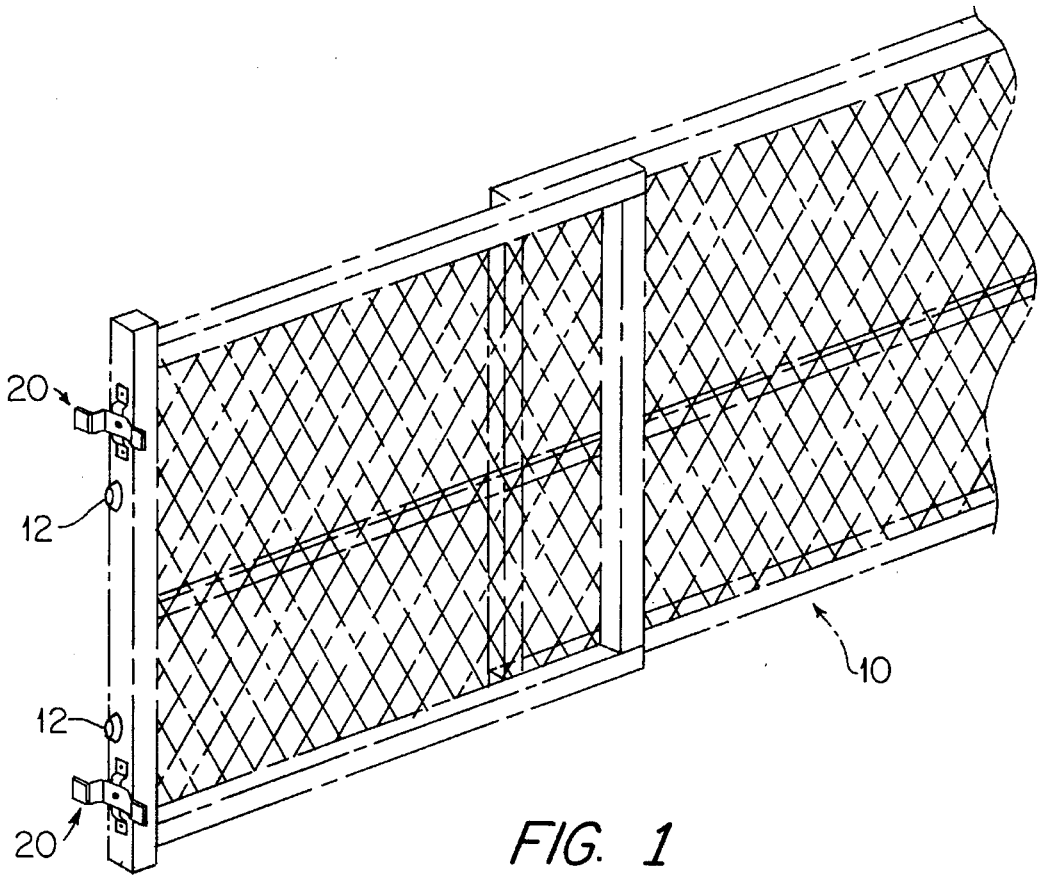
FIG. 1 is a view in perspective of invention showing the mode of horizontal positioning V-foot clamp of the bracket to a doorway jamb.

The purpose of invention is stated to be the increase in security of any pressure-mounted safety gate for toddler children. In conjunction with the fixed upright walls of a passageway or jambs of a doorway, the V-foot clamp is mounted for rotational connection with its pedestal anchor, the latter are being fixedly secured to an end of an extensible-retractable safety gate 10. The overall brackets 20 are most effective when secured in vertical series to opposite ends of the gate; four brackets are the optimum number to be attached. See FIG. 1.

Figure 2:
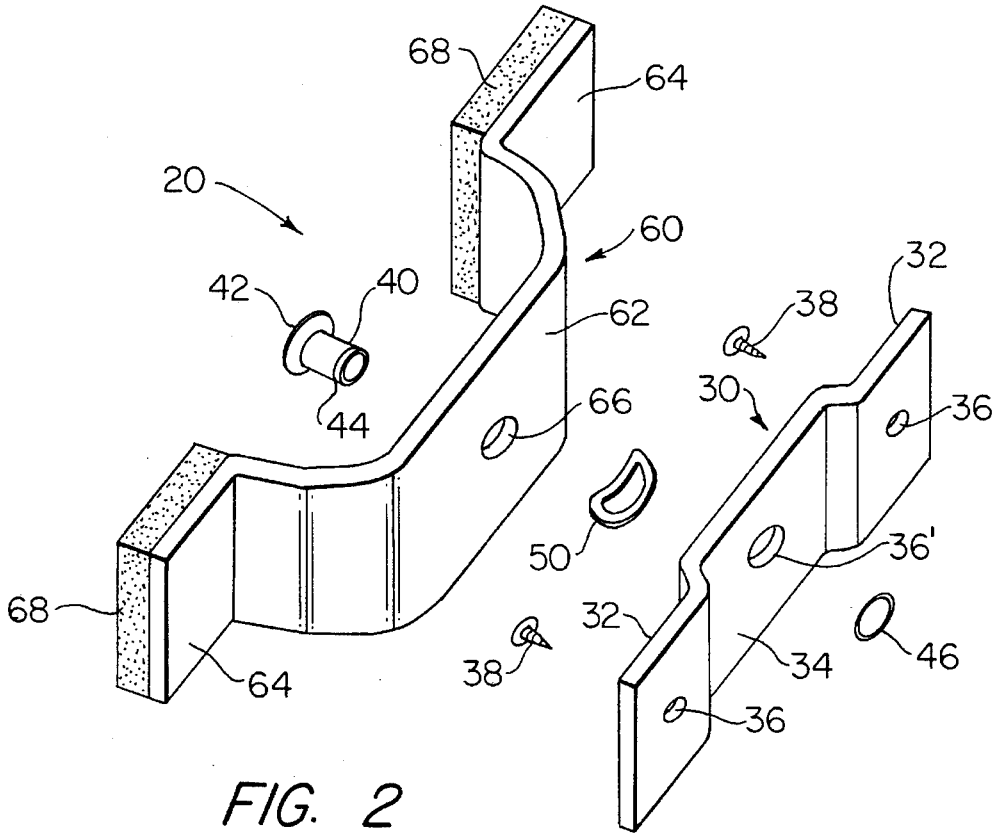
FIG. 2 is an exploded view in perspective of the safety gate bracket, illustrating the co-active relationship between the fixed anchor and clip of the bracket and associated connector elements.

Bracket 20 comprises a pedestal anchor 30. The anchor is formed of a semi-resilient material which is an elongated rectangular plate having flat shanks 32 extending offset outwardly from a raised anchor plate 34. The plate or shank 34 is of less depth than the relaxed protrusion of the gate buffer 12, permitting a coactive compression as between buffer and the V-foot pads. Appropriate apertures 36 are bored in the anchor such that it may be fixed by wood screws, metal screws, stove bolts or rivets to an extreme end of the gate 10, per se. The centermost aperture 36' provides a seat for a compression rivet 40 which joins the anchor to the V-foot clip 60. On its inner extremity, the rivet has its head extending laterally in contiguous contact with the connecting plate 34 of the pedestal anchor. Intermediate ends of the rivet there is provided a wave washer/compressor spring 50, hereinafter described. Thus, the rivet 40 is provided with a cap 42 holding its centermost shank at right angles relative to the V-foot 60. It is oppositely capped at 46 to the anchor/pedestal 30 by means of contactor clamp 44, intermediate the circular compressor spring 50, urging respective anchor and clip to opposed friction engagement, such that the V-foot 60, relative to the anchor 30, is rendered compressibly rotatable in a clutch-like relationship. See FIG. 2.

The V-foot clip 60 is provided with a curvilinear base 62 with transversely extending projections 64. Aperture 66 accommodates the shank of the rivet 50 of the connecting pivot member. Upon the exterior of each extension 64 are compressible pads 68. The pads are composed of a nonslipping, resilient elastomeric substance, the same being adapted to compressible contact with either the jamb of the doorway or opposed walls of a passageway.

Figure 3:
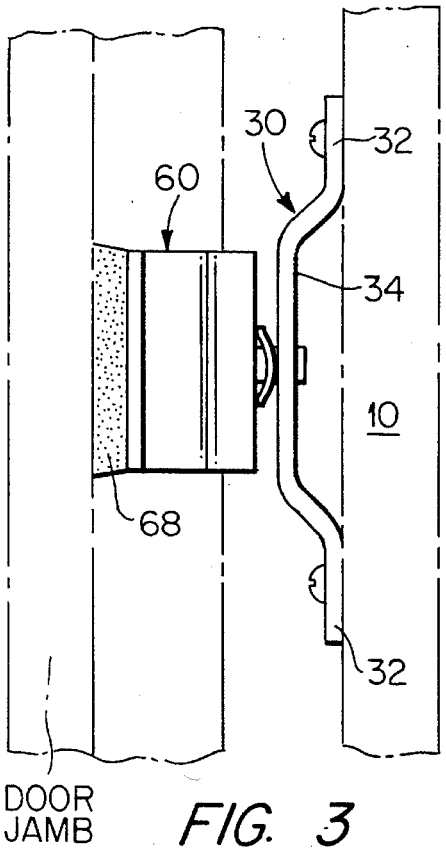
FIG. 3 is a view in side elevation of the main components of invention, wherein the clip is set horizontally, relative to a floor.
Figure 4:
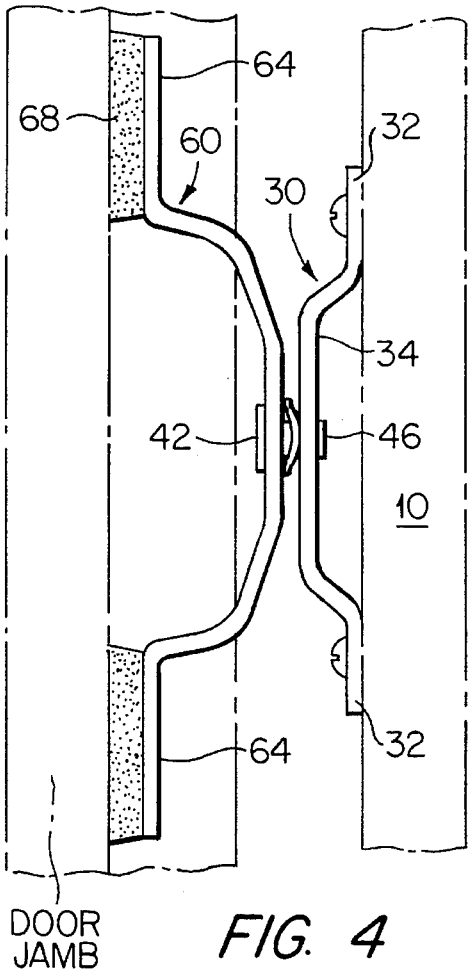
FIG. 4 is a view in side elevation of another mode of adaptability of invention to a doorjamb which has a vertical doorstop.
Figure 5:
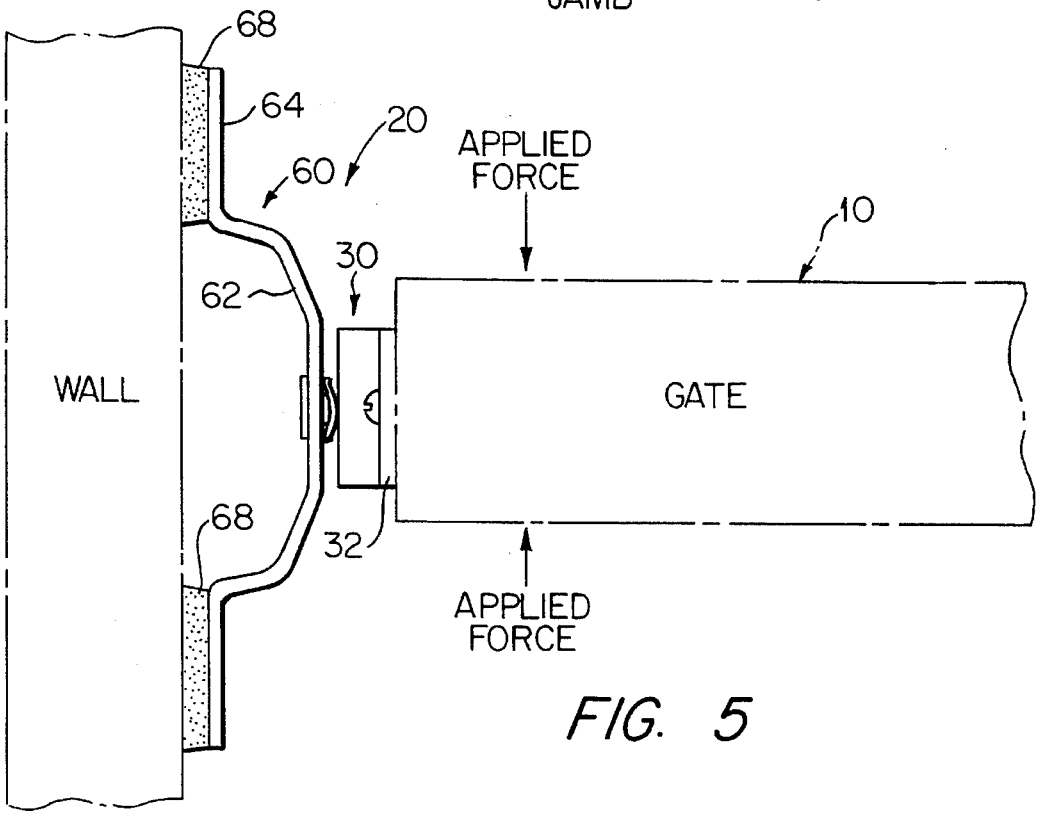
FIG. 5 is an alternate top plan view showing adaptation of the bracket of FIG. 4 to a blank wall, applied forces causing an even tighter clamp of the bracket to the wall.

The rotatable disposition of the V-foot clamp 60 relative to its anchor 30 is purposeful in that the user may opt for either vertical or horizontal disposition thereof, relative to the vertical ends of the safety gate. FIG. 3 represents horizontal clamping of the V-foot clamp 60 against the vertical protruding seal of a doorjamb. FIG. 4 represents the vertical positioning of the V-foot clamp 60 upon the doorjamb, the background being the doorstop. With either of them, the depth of the anchor 30 is such that it is less than the normal protrusion of the compressible gate buffer 12 found on extensible gates 10 of the type shown and herein described. Thus the clamping enhances the effect of the buffers 12. When the V-foot or clip 60 is horizontal and pressed against a flat wall surface as in FIG. 5, any push or pull on the gate 10 will have the apparent effect of tightening the gate against the jamb or wall; because it is locked in its extension, the gripping forces of the V-foot are such as to render the gate increasingly difficult to dislodge from the wall.

Whereas the invention has been defined with reference to specification and drawings, various modifications thereof will be apparent without departure from the scope of the ensuing claims.

I claim:

1. In combination with an extensible, pressure-mounted children's safety gate 10 of the type having confined, compressible passageway buffers 12 on ends thereof:

a) at least one safety gate security bracket 20 with a pedestal anchor 30, fixed outwardly to respective ends of gate 10, said pedestal anchor 30 defining a central aperture 36' therein to receive a common rivet 40;

b) at least one rotatable resilient clamp 60, disposed immediately opposite the pedestal anchor 30, said clamp 60 likewise having a central aperture 66 therein to receive common rivet 40;

c) a rivet 40 passing between respective central apertures 36' and 66, said rivet securing said anchor 30 to said clamp 60, the rivet 40 bearing a wave washer compression spring 50 thereon which has contact between opposed interior sides of anchor 30 and clamp 60;

whereby the gate 10 when extended may be removably secured against displacement, within a confined passageway.

2. The combination of children's safety gate of claim 1 the clamp 60 defining lateral V-foot extensions 64, each said extension 64 being buffered by outwardly extending compressible pads 68 which are in outward projection of the damp 60.

3. The combination for children's safety gates according to claim 2, said wave washer compression spring 50 defining a circular spring, axial extremities thereof bearing respectively upon inner sides of the pedestal anchor 30 and clamp 60.

4. The bracket for children's safety gates according to claim 3 wherein the pedestal anchor 30 defines an elevated shank 34 between end extensions thereof, the shank being of less depth than passageway buffers 12 of the gate.

* * * * *